United States Patent [19]

Fish

[11] 4,373,462

[45] Feb. 15, 1983

[54] FILLABLE STRUCTURE

[75] Inventor: Daniel C. E. Fish, Wimbourne, England

[73] Assignee: Leigh Flexible Structures Limited, Walsall, England

[21] Appl. No.: 151,633

[22] Filed: May 20, 1980

[51] Int. Cl.[3] ..... B63B 25/08

[52] U.S. Cl. ..... 114/74 R; 114/256; 137/207

[58] Field of Search ..... 114/74 R, 74 T, 256, 114/257; 229/62.5, DIG. 14; 150/5, 9; 137/207, 535, 587

[56] References Cited

U.S. PATENT DOCUMENTS

| | | | |
|---|---|---|---|
| 1,712,109 | 5/1929 | Hammer | 150/5 |
| 3,854,496 | 12/1974 | Broszeit | 137/535 |

FOREIGN PATENT DOCUMENTS

| | | | |
|---|---|---|---|
| 622800 | 6/1961 | Canada | 137/207 |
| 154150 | 9/1904 | Fed. Rep. of Germany | 9/311 |
| 7763 | of 1905 | United Kingdom | 150/5 |
| 874229 | 8/1961 | United Kingdom | 114/74 T |
| 891121 | 4/1962 | United Kingdom | 114/74 T |

*Primary Examiner*—Sherman D. Basinger

*Attorney, Agent, or Firm*—Cushman, Darby & Cushman

[57] ABSTRACT

A floating flexible structure which can be filled with liquid is defined by pieces fixed by side seams. The seams are rendered buoyant by trapped balls. A vent in the upper part of the container has under it a net bag filled with balls to maintain gas passage. A transverse tube of netting rendered buoyant by balls maintains liquid flow for discharge through a hose.

3 Claims, 7 Drawing Figures

FILLABLE STRUCTURE

This invention relates to fillable flexible structures specifically those structures which when filled with liquid provide a buoyant and towable container. One proposed use of such a structure is to allow oil spilt on water to be collected at the point of spillage and thereafter towed away for disposal.

A structure in accordance with the invention comprises an envelope capable of containing a fluid and made up of flexible pieces fixed together at least along longitudinally extending side seams. The side seam is rendered buoyant by trapped buoyancy elements and tends to stabilise the structure in the water.

The pieces should be formed of liquid tight, usually plastics, material.

A preferred clamping device for holding the flexible pieces together at one or both ends of the structure providing a closure comprises two clamping bars curved on a shallow radius. The bars are placed together trapping the material with convexities juxtaposed and on being urged together in clamping relationship the bars straighten.

In use the liquid contents of the structure tend to discharge gas which has to be vented to the atmosphere. More specifically liquid cargo sloping to one end or other of the interior of the structure renders the structure unstable to tow and reduces capacity. According to the present invention a venting assembly comprises a vent for securement to a wall of the structure, means biasing the vent to a closed position and a float inside the structure having a spacer at the surface adjacent the structure wall to maintain a gas passage between the vent and the structure interior containing the liquid.

The invention will now be described with reference to the accompanying informal drawings wherein.

Figure 6:
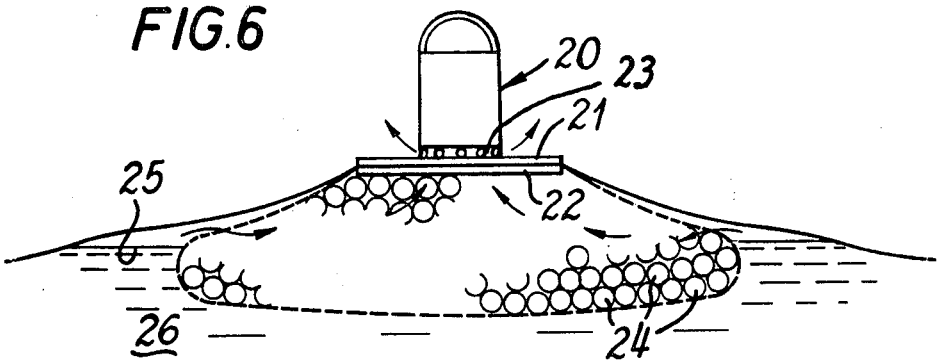

FIG. 6 schematically illustrates a venting assembly; and

Figure 7:
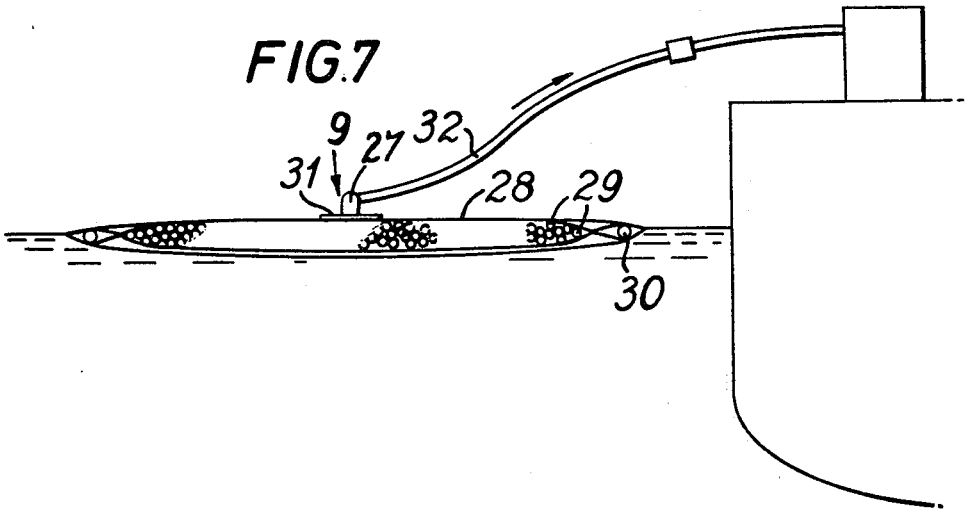

FIG. 7 schematically illustrates an assembly for discharging the contents.

In the drawings the structure is shown in its filled functional state wherein it constitutes a towable tank for liquid. The structure is made up of four pieces fixed together by side seams 1 and 2 and upper and lower seams 3 and 4. The front parts of the pieces making up the envelope are closed by a clamping device 5 which subsequently will be described in detail, whilst the rear end is covered by a simplified clamping device 6 made up of a pair of triangular plates and having a shackle 7 for a tow rope. A gas vent 8 and a loading and discharge hose connection 9 are provided at the upper part of the structure.

Figure 1:
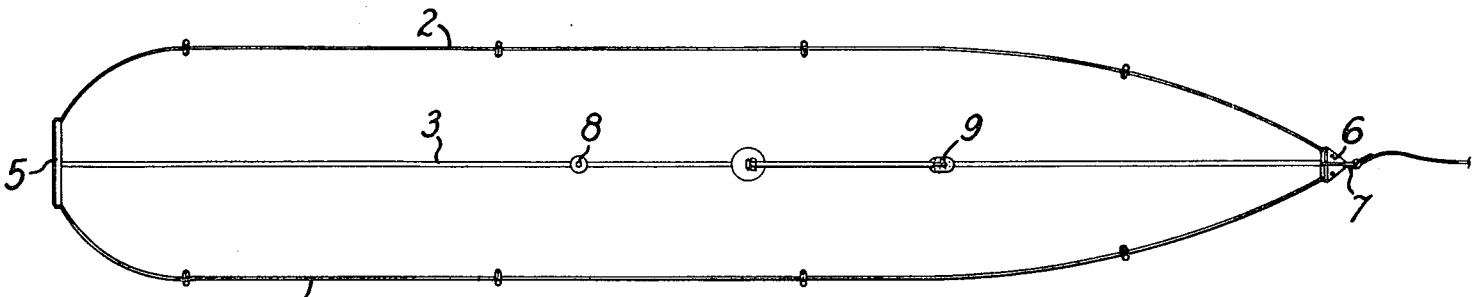
FIG. 1 is a plan view of a towable structure in accordance with the invention.
Figure 2:
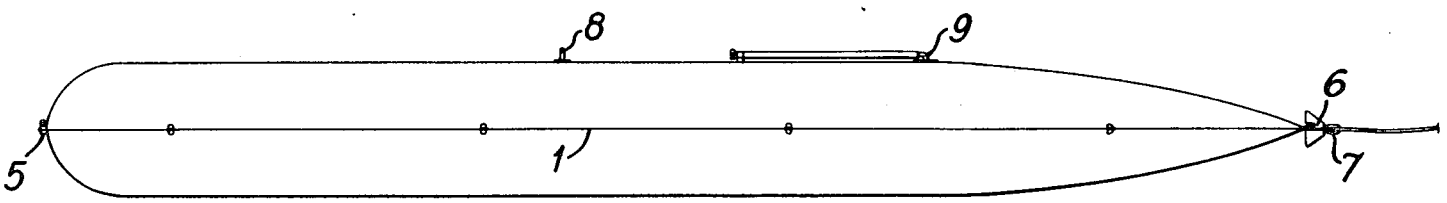
FIG. 2 is a side view.
Figure 3:
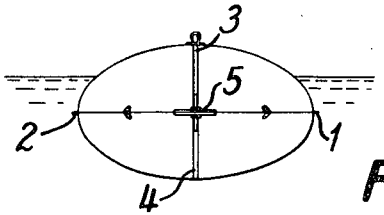
FIG. 3 is a front view.
Figure 4:
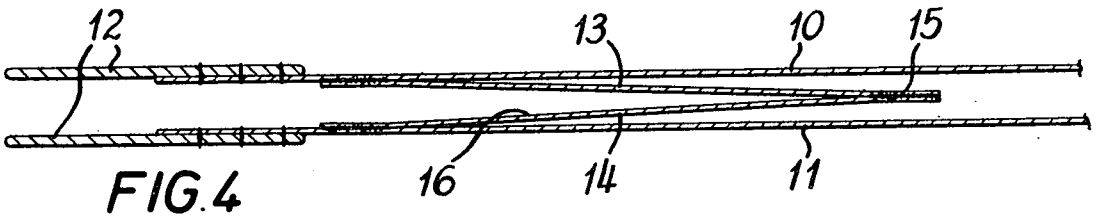
FIG. 4 is a detailed view of the seam.

The detailed construction of the side seam will now be described with reference to FIG. 4 of the drawings.

The seam is a pinch seam, that is to say in use it defines a laterally extending flange and in the drawing reference numerals 10 and 11 denote the edge parts of pieces of the envelope proper. These edge parts are fastened by a straight row of polyester stitches to webbing strips 12 which are joined together by a zig-zag row of polyester stitches. Welded to the inner surfaces of the envelope edge parts 10 and 11 are two pieces 13 and 14 of weldable plastic material which are joined to each other at their inner edge parts at 15. In the passage 16 thereby defined and closed by joining the webbing pieces are incorporated buoyancy balls (not shown in the figure but illustrated as 30 in FIG. 7) which extend in single file the length of the structure.

Figure 5:
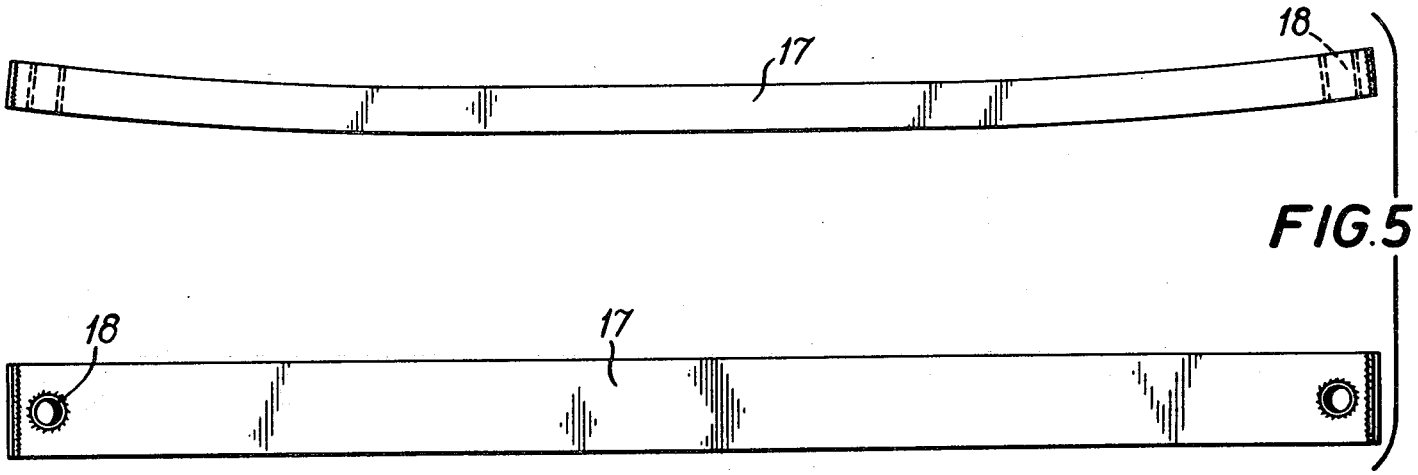
FIG. 5 shows a clamping device for the front end of the structure.

FIG. 5 shows the clamping device which comprises two shallowly (i.e. the end parts are 15° from the straight) convex bars 17 securable together at the end part by bolts through holes 18. In use the envelope parts to be clamped are interposed between the pair of bars with the convexities in contact with another. When the bars are secured together by the bolts they straighten and trap the envelope parts at the nose of the tank.

FIG. 6 of the accompanying drawings shows schematically a venting assembly to discharge the function of vent 8 described above. The assembly illustrated comprises a screw down closure vent 20 associated with plates 21 and 22 which trap the structure wall. Means not shown such as a spring are provided for normally biassing the vent to the closed position whereat no gas escapes. In the open or venting position illustrated gas escapes from the annular gap 23. In order to maintain a gas passage between the interior of the container and the venting assembly a float comprising a net bag filled with plastic balls 24 floats on the surface 25 of the liquid 26 in the structure. The bag of balls whatever the situation in the structure acts as a porous spacer to maintain the gas passage.

Discharge is achieved by sucking through a hose at 9 in FIG. 7. The hose is attached to a metal flange by means of a rigid metal elbow 27 on the top of the container, again approximately half way down its length. The hose streams along the top of the container when it is underway, being retained at the free, aft end, by a strap and having a screwed-on cap on the end of the hose to prevent the cargo escaping. When sucking the liquid cargo out through the hose, as the container empties, the fabric walls of the envelope may either suck together or, alternatively, be sucked over the flange exit, to prevent the flow. It has been found that longitudinal internal buoyancy tubes hold the top of the container to the surface of the water and provide a channel allowing the liquid to flow from one end of the container to the other. The liquid may flow along the length of the container because the two sides of the container are held on the surface by means of the strings of plastic balls 30 contained within the side seams. However, the liquid may not be able to flow from the sides, in towards the centre. To overcome this we fit a transverse tube of netting 28 filled with plastic buoyant balls 29, which goes from one side of the container to the other, inside, being joined to the side seam at both sides and to the centre flange 31 or discharge hose 32 in the middle. The buoyant netting bag thus held on the surface provides a path for the liquid to flow and stops the two layers of fabric being sucked together.

I claim:

1. A floatable fillable structure comprising flexible pieces fixed together at least along longitudinally extending side seams, each seam defining a laterally extending piece with an internal longitudinally extending passage, discrete buoyancy elements trapped in said passages thereby providing a buoyant, stable structure which floats in the correct orientation, a vent normally biased to the closed position secured to an upper wall of the structure and a floating spacer composed of a net bag containing balls under the vent to maintain a gas passage between the vent and the interior of the structure.

2. A structure as claimed in claim 1 clamped together at the ends by a closure comprising two clamping bars curved on a shallow radius.

3. A structure as claimed in claim 1 wherein a buoyant element extends across the interior of the structure.

* * * * *